United States Patent [19]

Henneberger et al.

[11] Patent Number: 4,658,520

[45] Date of Patent: Apr. 21, 1987

[54] STEAM IRON SOLEPLATE

[75] Inventors: Gerd Henneberger, Frankfurt am Main; Robert Walter, Eppertshausen; Rolf Thomas, Hanau; Ernst Bechstein; Norbert Voss, both of Offenbach am Main, all of Fed. Rep. of Germany

[73] Assignee: Rowenta-Werke GmbH, Fed. Rep. of Germany

[21] Appl. No.: 870,678

[22] Filed: Jun. 4, 1986

[30] Foreign Application Priority Data

Jun. 5, 1985 [DE] Fed. Rep. of Germany ... 8516445[U]
Feb. 5, 1986 [DE] Fed. Rep. of Germany ..... 3603409

[51] Int. Cl.[4] ..... D06F 75/16; D06F 75/38
[52] U.S. Cl. ..... 38/93; 38/77.83
[58] Field of Search ..... 38/93, 77.83, 88, 77.9

[56] References Cited

U.S. PATENT DOCUMENTS 2,708,801 5/1955 Voskresenski ..... 38/77.83
2,846,793 8/1958 Studer ..... 38/93 X
3,811,208 5/1974 Vieceli et al. ..... 38/88 X

*Primary Examiner*—Henry S. Jaudon
*Assistant Examiner*—Andrew M. Falik

[57] ABSTRACT

An electrically heated steam iron has a soleplate in which are arranged an electrical heating element and a vaporization chamber, and a soleplate liner which consists of a different material from the soleplate and which is fixed thereto. The soleplate is provided with steam escape holes which communicate with respective openings in the soleplate liner, each such opening having a steam distribution groove on the ironing surface of the soleplate liner. The soleplate has recesses each congruent to a respective steam distribution groove and the longitudinal axes of all the grooves are directed towards the center of gravity of the ironing surface of the soleplate liner.

6 Claims, 4 Drawing Figures

STEAM IRON SOLEPLATE

BACKGROUND OF THE INVENTION

The invention relates to an electrically heated steam iron comprising a soleplate in which are arranged an electrical heating element and a vaporization chamber, and a soleplate liner made of a different material from the soleplate and secured to the underside thereof.

Soleplates for electrically heated steam irons are generally made from a single material, preferably aluminum or steel. Aluminum soleplates are intrinsically lightweight and have good heat conducting properties while having poor resistance to abrasion, while steel soleplates are heavy and have poor heat conducting properties but are highly resistant to abrasion. In order to make use of the advantages and disadvantages of both types of material, it is known to file a thin-walled steel soleplate liner to an electrically heated aluminum soleplate (German Gebrauchsmuster No. 19 39 634). As is well known, steel and aluminum have different coefficients of expansion. When temperature variations occur, as a result of the different coefficients of expansion of steel and aluminum, tensions are produced between the thin-walled steel soleplate liner and the electrically heated aluminum soleplate which stresses the material. Such stresses may exceed the elastic limit of the soleplate and liner materials, possibly causing deformation particularly of those parts of the steel soleplate liner in which steam distribution grooves run at right angles to the direction of expansion.

The center of gravity of the surface is the central starting point for the thermally produced stresses, and the stresses run in straight lines from this point outwardly. The center of gravity of the surface does not change its position. Plastic deformation occurs in the steel soleplate liner, particularly in the region of the steam distribution grooves, and this deformation is not reversed as the temperature changes but remains visible. Such deformation not only makes a steam iron of this kind visually unattractive but also renders the steam iron technically unusable since the finished appearance of fabric ironed with an iron deformed in this way is very poor. Furthermore, the deformation of the steel soleplate liner may cause cracking to a greater or lesser extent in the steel soleplate liner, which will damage the fabric during ironing.

SUMMARY OF THE INVENTION

The main aim of this invention is to provide an electrically heated steam iron having a soleplate and a soleplate liner fixed thereto, in which the soleplate and soleplate liner are made of materials with different compositions but have no permanent plastic deformation of the soleplate liner caused by different coefficients of expansion of the individual materials.

According to the invention there is provided an electrically heated steam iron comprising a soleplate in which are arranged an electrical heating element and a vaporization chamber, and a soleplate liner made of a different material from the soleplate and secured to the underside thereof, the soleplate being provided with steam escape holes which communicate with corresponding openings in the soleplate liner, each such opening communicating with a steam distribution groove on the ironing surface of the soleplate liner, the soleplate having recesses on its underside each congruent to a respective steam distribution groove provided on the liner, and the longitudinal axes of all the grooves and recesses being directed toward the center of gravity respectively of the ironing surface of the soleplate liner and of the underside of the soleplate.

With such an arrangement, no permanent deformation of the soleplate and its liner is produced by thermal stresses. In general, the center of gravity of the ironing surface of the soleplate liner or of the underside of the soleplate is the central starting point for the thermally produced expansion on heating or for the thermally produced contraction on cooling. The expansion generally extends in straight lines out from the center of gravity to the edge of the soleplate, while the center of gravity itself does not change its position on heating or cooling. The permanent deformation which occurs to a greater extent in the region of the steam distribution grooves in known steam irons does not occur in the steam iron of the present invention due to the arrangement of the grooves according to the invention.

Preferably, the steam escape holes are arranged in the region of the grooves or recesses remote from the center of gravity. This ensures that any expansion which may occur is largely deflected into the steam distribution grooves.

In a preferred embodiment of the invention, one or more interconnected channels are provided in the underside of the soleplate, there being at least one hole passing through the soleplate and communicating with the channel(s). The cross section of this hole might widen out toward the underside of the soleplate. The hole can be used to introduce heat conducting paste between the soleplate liner and the soleplate so as to improve heat transfer. For example, the heat conducting paste may be forced through the hole into the channel(s) in the soleplate to spread uniformly over the entire underside of the soleplate.

Preferably the soleplate liner has a peripheral portion which extends upwardly and over an outer thickened edge of the soleplate to form a peripheral bead, there being a surface which is substantially parallel to the ironing surface of the soleplate liner defined inwardly of the bead and providing an abutment for a hood or shell of the iron.

Such an arrangement can ensure that the soleplate liner is secured to the soleplate while providing an abutment surface for the hood of the iron. The hood might be shaped so as to clip positively into position, for example against the inner face of the peripheral bead.

In a preferred embodiment of the invention, before the soleplate liner, formed e.g. of steel, and the soleplate are joined together, the openings in the soleplate liner, in the region of the steam escape holes in the soleplate, have an appreciably smaller cross section than the steam escape holes in the soleplate. By mechanical widening of the holes in the direction of the soleplate, soleplate liner material is displaced into the steam escape holes of the soleplate, bonds itself to the soleplate and thus secures the steel soleplate liner to the soleplate. Consequently, no further security means are required.

DESCRIPTION OF THE PREFERRED EMBODIMENTS

Figure 1:
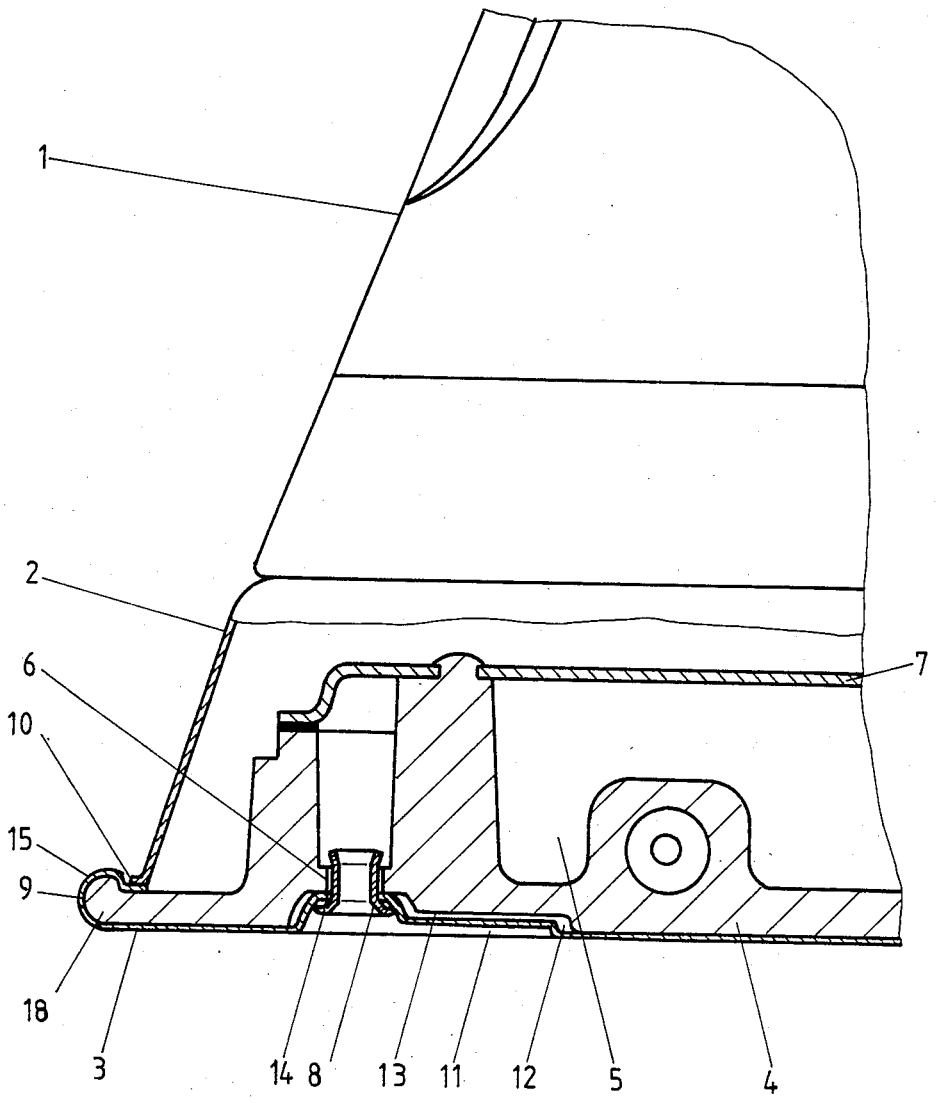
FIG. 1 is a side elevational view of the front end of a steam iron, shown partially in vertical section, embodying one form of the invention.

The part of the steam iron shown comprises, in FIG. 1, part of a handle 1, a hood or shell 2, an aluminum soleplate 4 and a steel soleplate liner 3. The steel soleplate liner 3 is secured to the aluminum soleplate 4 by methods to be described. In the soleplate 4 are provided the vaporization chamber 5 and the steam escape holes 6. The vaporization chamber 5 is sealed off in the usual manner by a cover 7. In the FIG. 1 embodiment, the steel soleplate liner 3 is secured to the soleplate 4 by means of hollow rivets 8 which pass through the steam escape holes 6 in the soleplate 4 and by fitting the peripheral portion 9 of the steel soleplate liner 3 around the outer edge of the soleplate 4 as shown in FIG. 1. The encircling peripheral portion 9 of the steel soleplate liner 3 is drawn over the edge of the soleplate, which has a thickened portion 18, so as to form a bead 15. In the region of the hood 2 the steel soleplate liner 3 has a bent portion with a surface 10 serving as an abutment for the hood 2, which is positively secured thereto by suitable means.

Figure 2:
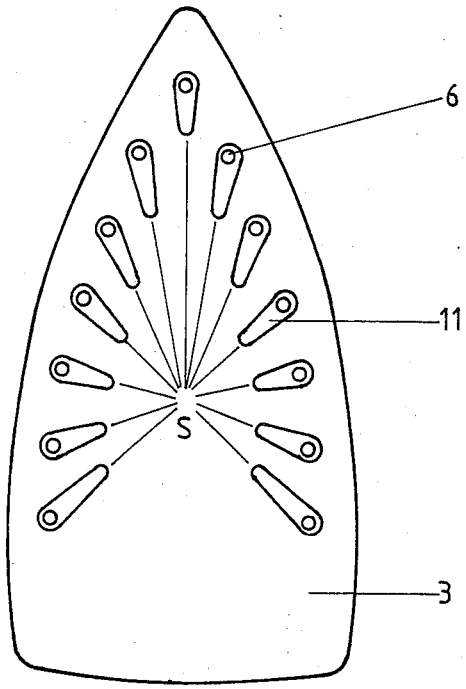
FIG. 2 is a bottom plan view of the embodiment of the iron shown in FIG. 4 looking toward the ironing surface of the soleplate liner.

The soleplate liner 3 is formed with openings 14 and with steam distribution grooves 11 each in the region of a respective opening 14, and each corresponding to a congruent recess 12 provided in the soleplate 4. The longitudinal axes of the grooves 11 are directed toward the center of gravity "S" of the surface (the centroid) of the steel soleplate liner 3 (as shown in FIG. 2), while the recesses 12 are directed toward the center of gravity of the underside 13 of the soleplate 4.

Figure 3:
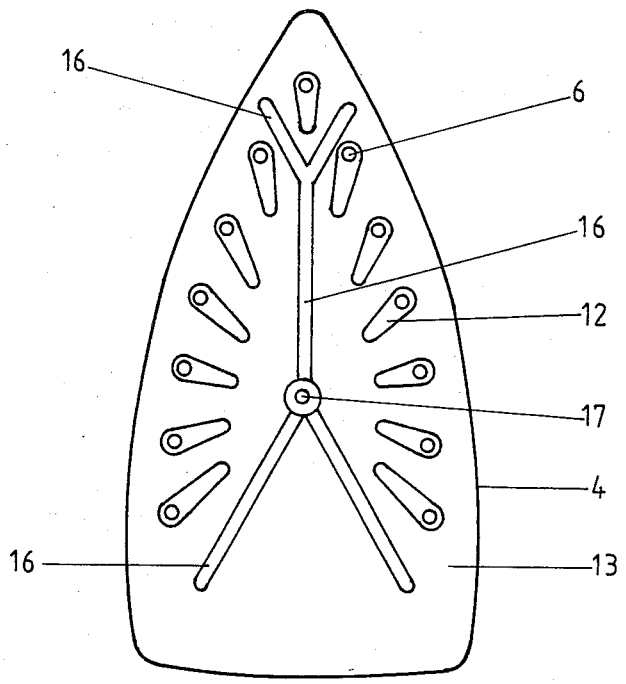
FIG. 3 is a bottom plan view of the soleplate of the embodiment of the iron shown in FIG. 4 prior to assembly of the soleplate liner thereto.
Figure 4:
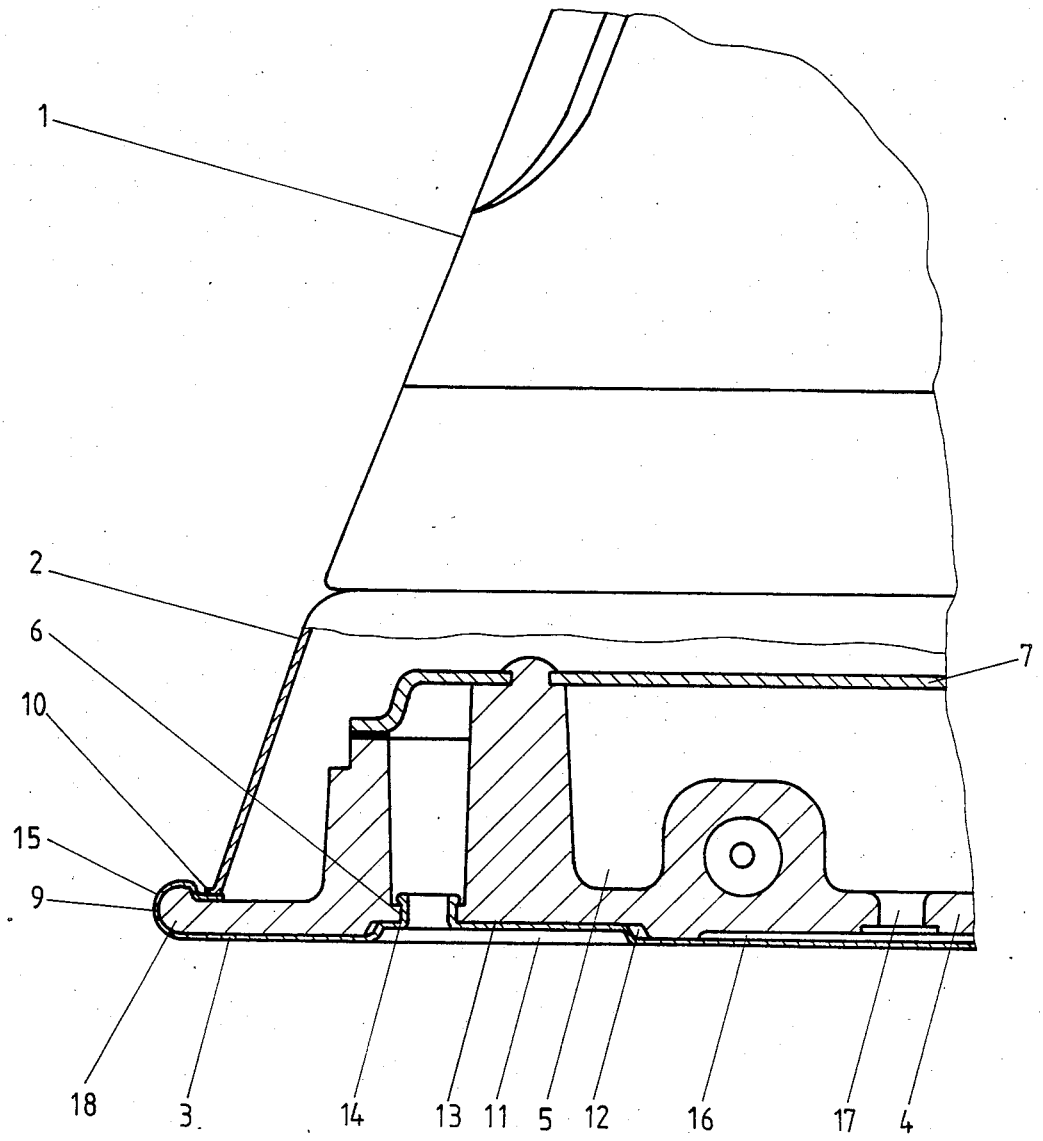
FIG. 4 is a side elevational view of the front end of a steam iron, shown partially in vertical section, similar to FIG. 1 but embodying another form of the invention.

FIGS. 3 and 4 show interconnected channels 16 provided in the underside 13 of the soleplate 4, these channels being connected to a hole 17 passing through the soleplate 4, the cross section of this hole 17 widening out towards the underside 13. On assembly, a heat conducting paste is forced through the hole 17 between the steel soleplate liner 3 and the soleplate 4. The paste is uniformly distributed over the entire underside 13 through the channels 16.

In the embodiment of FIG. 4, the steel soleplate liner 3 is secured to the soleplate 4 by deformation, rather than by using rivets. The holes 14 in the steel soleplate liner 3, in the region of the steam escape holes 6 in the soleplate 4, have an appreciably smaller cross section than the steam escape holes 6 before the steel soleplate liner 3 and the soleplate 4 are joined together. The holes 14 in the steel soleplate liner 3 are mechanically widened in the direction of the soleplate 4. As a result, material from the region of the holes in the steel soleplate liner 3 is displaced into the steam escape holes 6 in the soleplate 4. The bearing pressure of the displaced material exerts a holding force on the inner wall of the steam escape holes 6, by means of which the steel soleplate liner 3 is secured to the soleplate 4. Hollow rivets 8 for securing the steel soleplate liner 3 to the soleplate 4, as shown in the embodiment of FIG. 1, are thus not necessary.

Modifications to the broad aspects of the steam iron and to the specific embodiments thereof referred to or suggested herein may be apparent to those skilled in the art and this disclosure is intended to encompass any and all such modifications.

What is claimed as new and desired to be secured by Letters Patent of the United States is:

1. An electrically heated steam iron comprising a soleplate having an underside, an electrical heating element and a vaporization chamber provided therein, a soleplate liner made of a different material from the soleplate and secured to the underside thereof to provide an ironing surface, the soleplate having steam escape holes and the soleplate liner having openings each positioned to receive steam from a respective escape hole, each such opening communicating with a steam distribution groove on the ironing surface of the soleplate liner, the soleplate having recesses on its underside each congruent to a respective steam distribution groove, and the longitudinal axes of all the grooves and recesses being directed towards the center of gravity respectively of the ironing surface of the soleplate liner and of the underside of the soleplate.

2. A steam iron as claimed in claim 1, wherein the steam escape holes are arranged in the region of the grooves or recesses remote from the center of gravity.

3. A steam iron as claimed in claim 1, wherein one or more interconnected channels are provided in the underside of the soleplate, there being at least one hole passing through the soleplate and communicating with the channels(s).

4. A steam iron as claimed in claim 1, wherein the soleplate liner material penetrates through the soleplate in the region of the steam escape holes so as to secure the soleplate liner to the soleplate.

5. A steam iron as claimed in claim 1, wherein the soleplate liner is secured to the soleplate by means of rivets in the region of the steam escape holes.

6. An electrically heated steam iron comprising a soleplate having an underside and an outer thickened edge, an electrical heating element and a vaporization chamber provided therein, a soleplate liner made of a different material from the soleplate and secured to the underside thereof to provide an ironing surface, the soleplate liner having a peripheral portion which extends upwardly and over the outer thickened edge of the soleplate to form a peripheral bead, a hood mounted on an abutment surface of said liner disposed inwardly of said bead, said abutment surface being substantially parallel to the ironing surface of the soleplate liner, the soleplate having steam escape holes and the soleplate liner having openings each positioned to receive steam from a respective escape hole, each such opening communicating with a steam distribution groove on the ironing surface of the soleplate liner, the soleplate having recesses on its underside each congruent to a respective steam distribution groove, and the longitudinal axes of all the grooves and recesses being directed towards the center of gravity respectively of the ironing surface of the soleplate.

* * * * *